US010138660B2

(12) United States Patent
Uyeda

(10) Patent No.: US 10,138,660 B2
(45) **Date of Patent: *Nov. 27, 2018**

(54) MULTIPLE POINT DOOR LOCKING SYSTEM

(71) Applicant: Hanchett Entry Systems, Inc., Phoenix, AZ (US)

(72) Inventor: Alan K. Uyeda, Irvine, CA (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/981,305

(22) Filed: Dec. 28, 2015

(65) Prior Publication Data

US 2016/0108651 A1 Apr. 21, 2016

Related U.S. Application Data

(63) Continuation of application No. 12/383,140, filed on Mar. 20, 2009, now Pat. No. 9,222,286.

(51) Int. Cl.
*E05C 7/00* (2006.01)
*E05C 1/00* (2006.01)
(Continued)

(52) U.S. Cl.
CPC ..... *E05C 9/10* (2013.01); *E05B 17/2038* (2013.01); *E05B 59/00* (2013.01); *E05B 63/16* (2013.01);
(Continued)

(58) Field of Classification Search
CPC ... E05C 9/10; E05C 1/002; E05C 1/10; E05C 1/08; E05C 1/085; E05C 3/12;
(Continued)

(56) References Cited

U.S. PATENT DOCUMENTS 1,041,388 A 10/1912 Wegmann
1,646,674 A 10/1927 Angelillo
(Continued)

FOREIGN PATENT DOCUMENTS

CN 1592812 3/2005
CN 1749515 3/2006
(Continued)

OTHER PUBLICATIONS

State Intellectual Property Office of the People's Republic of China, "Notification of the First Office Action," for Chinese Application No. 201080019420.4, filed Mar. 1, 2010, dated Aug. 5, 2013, Beijing, China.

(Continued)

*Primary Examiner* — Kristina R Fulton
*Assistant Examiner* — Faria F Ahmad
(74) *Attorney, Agent, or Firm* — Woods Oviatt Gilman LLP; Ronald J. Kisicki, Esq.

(57) ABSTRACT

A door lock system comprising a first rotary configured to control extension and retraction of the deadbolt via a primary cam mechanism; a second rotary control configured to control extension and retraction of the latch; and a link configured to retract the deadbolt in response to operation of the second rotary control when the latch is retracted by the second rotary control. The link is configured to move along a linear path normal to the movement of the deadbolt and the door latch and to contact the primary cam mechanism upon the link movement to affect deadbolt retraction and extension. A lever may be used to retract the latch in response to rotation of the first rotary control in a first rotational direction when the deadbolt is retracted by the first rotary control.

8 Claims, 22 Drawing Sheets

(51) Int. Cl.

| | |
|---|---|
| ***E05C 9/10*** | (2006.01) |
| ***E05B 17/20*** | (2006.01) |
| ***E05B 59/00*** | (2006.01) |
| ***E05B 63/16*** | (2006.01) |
| ***E05B 65/10*** | (2006.01) |
| ***E05C 1/10*** | (2006.01) |
| *E05C 1/02* | (2006.01) |
| *E05C 1/06* | (2006.01) |
| *E05C 1/12* | (2006.01) |
| *E05C 9/00* | (2006.01) |
| *E05C 9/16* | (2006.01) |
| *E05B 15/10* | (2006.01) |

(52) U.S. Cl.
CPC ..... *E05B 65/1086* (2013.01); *E05C 1/002* (2013.01); *E05C 1/10* (2013.01); *E05B 15/104* (2013.01); *Y10T 70/5239* (2015.04)

(58) Field of Classification Search
CPC ..... E05B 55/00; E05B 59/00; E05B 63/14; E05B 63/143; E05B 63/146; E05B 17/20; E05B 17/2007
USPC .... 70/107–111; 292/3, 32, 34, 36, 137, 140, 292/165, 169.13
See application file for complete search history.

(56) References Cited

U.S. PATENT DOCUMENTS 1,706,486 A 3/1929 Gasey
3,640,560 A 2/1972 Zawadzki et al.
3,672,714 A 6/1972 Schultz
4,429,556 A 2/1984 Kambic
4,583,382 A * 4/1986 Hull ..... E05B 59/00 70/107
4,643,007 A 2/1987 Fish et al.
4,677,834 A 7/1987 Hicks
4,691,542 A 9/1987 Young
4,695,082 A * 9/1987 Marks ..... E05B 63/044 292/169.16
4,809,526 A 3/1989 Shen
4,838,053 A 6/1989 Shen
4,934,800 A 6/1990 Choi
5,042,316 A 8/1991 Gressett, Jr.
5,076,625 A 12/1991 Oxley
5,077,992 A 1/1992 Su
5,083,448 A 1/1992 Vesa Karkkanainen et al.
5,096,237 A 3/1992 Hotzl
5,113,676 A 5/1992 Panossian
5,118,150 A 6/1992 Jarrett
5,184,523 A 2/1993 Nyzedatny
5,265,920 A 11/1993 Kaup et al.
5,433,495 A 7/1995 Uffner
5,482,334 A 1/1996 Hotzl
5,490,699 A 2/1996 Uyeda
5,495,731 A 3/1996 Riznik
5,509,703 A 4/1996 Lau et al.
5,513,505 A 5/1996 Dancs
5,524,941 A 6/1996 Fleming
5,655,393 A 8/1997 Kuo et al.
5,658,026 A 8/1997 Nigro, Jr. et al.
5,765,410 A 6/1998 Kwan et al.
5,819,562 A 10/1998 Christ
6,023,952 A 2/2000 Mantarakis et al.
6,050,115 A 4/2000 Schroter et al.
6,125,670 A * 10/2000 Fuss ..... E05B 63/20 70/107
6,170,305 B1 1/2001 Shen
6,209,931 B1 4/2001 Von Stoutenborough et al.
6,266,981 B1 7/2001 von Resch et al.
6,302,456 B1 10/2001 Errani
6,324,876 B1 12/2001 Prevot et al.
6,578,888 B1 * 6/2003 Fayngersh ..... E05B 63/20 292/169.14
6,581,423 B2 6/2003 Lin
6,758,070 B2 7/2004 Yu et al.
6,810,699 B2 11/2004 Nagy
6,813,915 B2 * 11/2004 Chang ..... E05B 65/1086 292/165
6,851,287 B1 2/2005 Yang et al.
6,871,884 B2 3/2005 Hoffmann et al.
6,993,946 B1 2/2006 Shen
6,994,383 B2 2/2006 Morris
7,013,688 B2 3/2006 Chen
7,101,195 B2 9/2006 Brooks
7,181,940 B2 2/2007 Lin
7,249,477 B2 7/2007 Toloday et al.
7,257,973 B2 8/2007 Romero et al.
7,303,215 B2 12/2007 Moon et al.
7,353,674 B2 * 4/2008 Raatikainen ..... E05B 47/0688 70/107
7,363,784 B2 4/2008 Shvarts
7,364,212 B1 4/2008 Fan
7,431,354 B2 10/2008 Raatikainen
7,661,279 B2 2/2010 Huang et al.
7,677,067 B2 3/2010 Riznik et al.
7,712,343 B2 5/2010 Smith et al.
7,836,738 B2 11/2010 Tien et al.
7,849,719 B2 12/2010 Chern
7,856,857 B2 * 12/2010 Tsai ..... E05C 9/004 292/34
8,061,166 B2 * 11/2011 Tsai ..... E05C 9/10 292/35
8,272,169 B2 9/2012 Mahdi
8,292,336 B2 * 10/2012 Moon ..... E05B 55/00 292/143
8,419,084 B2 4/2013 Ding et al.
8,491,019 B2 7/2013 Uyeda
8,540,288 B2 9/2013 Tsai
8,671,724 B2 3/2014 Uyeda
8,875,549 B2 11/2014 Chang et al.
9,074,391 B2 * 7/2015 Van Parys ..... E05B 65/06
9,222,286 B2 * 12/2015 Uyeda ..... E05B 17/2038
9,341,000 B2 * 5/2016 Van Parys ..... E05B 65/1086
2001/0005084 A1 6/2001 Ponziani
2002/0104339 A1 * 8/2002 Saner ..... E05C 9/1841 70/108
2003/0019256 A1 1/2003 Frolov
2003/0159478 A1 8/2003 Nagy
2003/0199223 A1 10/2003 Spurr
2004/0079123 A1 4/2004 Alchin et al.
2004/0089040 A1 * 5/2004 Raatikainen ..... E05B 47/0688 70/283
2004/0107746 A1 6/2004 Chang
2004/0194519 A1 10/2004 Chen
2004/0239121 A1 12/2004 Morris
2005/0092040 A1 5/2005 Chuang
2005/0262906 A1 12/2005 Romero et al.
2006/0123859 A1 6/2006 Gonzalez
2006/0191303 A1 8/2006 Shvarts
2007/0051143 A1 3/2007 Raatikainen et al.
2007/0096475 A1 5/2007 Raatikainen
2007/0113603 A1 5/2007 Polster
2007/0266747 A1 11/2007 Rafferty et al.
2008/0156048 A1 7/2008 Topfer
2009/0078011 A1 * 3/2009 Avni ..... E05B 63/20 70/486
2009/0267358 A1 10/2009 Bourgain et al.
2009/0282877 A1 * 11/2009 Laverty ..... E05B 59/00 70/107
2009/0308112 A1 12/2009 Uyeda
2011/0252709 A1 10/2011 Uyeda

FOREIGN PATENT DOCUMENTS

EP 1717391 A2 11/2006
TW 453386 9/2001
TW I225117 12/2004
TW M341085 9/2008

(56) References Cited

FOREIGN PATENT DOCUMENTS

| | | | |
|---|---|---|---|
| WO | 2004092513 | A3 | 10/2004 |
| WO | 200707862 | A1 | 1/2007 |

OTHER PUBLICATIONS

Lawrence, Philip, Office Action, GB Patent Application No. 1400690.2, dated Feb. 20, 2014, 7 pages.
Taiwan Patent Office, Office Action, TW Patent Application No. 099107868, dated Feb. 21, 2014.

* cited by examiner 5
6
11
53
25
55
61
19
21
43
40b
50
40
27a
27
32
40a
5
6

11
53
53a
61a
26
62
61
10
43
42
50
36a
24a
19
95
19a
61a
19
21a
21
40b
28

11
53
53a
61a
62
19b
61
61b
43
21
56
27
50
28
36a
27a 53
53a
61a
62
61
19
61b
56
21
50
36a
27a
79
95
196
21a
28

FIG. 22.
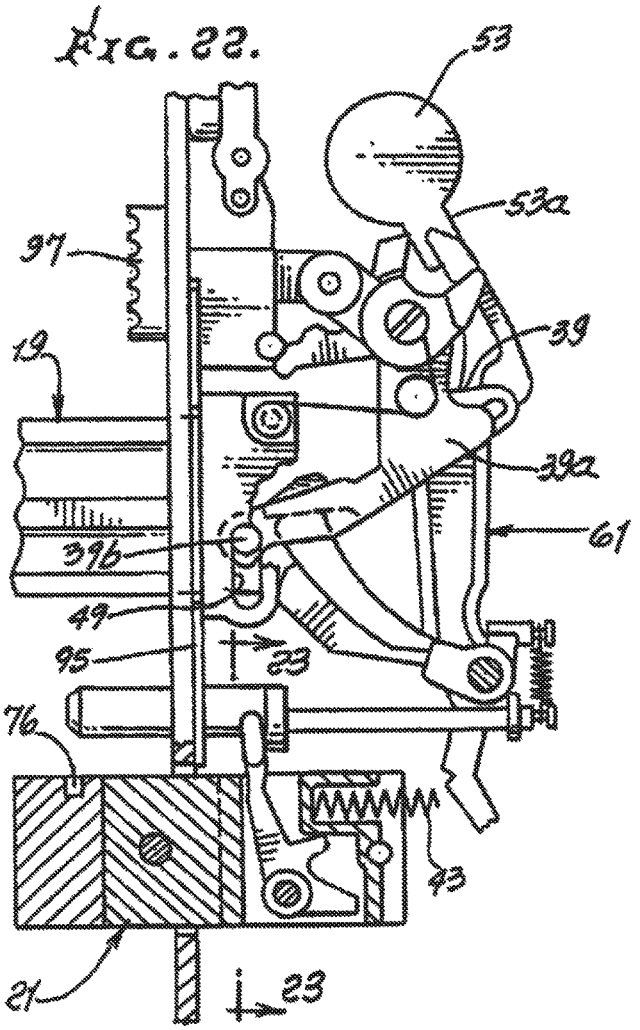
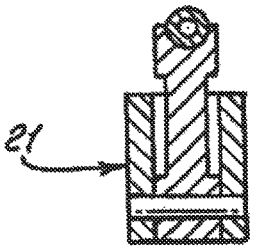
FIG. 23.

MULTIPLE POINT DOOR LOCKING SYSTEM

CROSS-REFERENCE TO RELATED APPLICATIONS

This application is a continuation of U.S. patent application Ser. No. 12/383,140, filed Mar. 20, 2009, now U.S. Pat. No. 9,222,286, the content of which is hereby incorporated by reference in its entirety.

BACKGROUND OF THE INVENTION

This invention relates generally to controlling the locking and unlocking of doors; and more particularly concerns provision of highly compact and improved mechanism for enabling operating of latches and deadbolts, as from opposite sides of doors.

There is need for simple, highly compact, durable and efficient door locking and unlocking devices, where deadbolts and latches are to be operated, as from the inner and outer sides of doors. In particular, there is need for improvements in mechanism responsive to door handle turning, at the door inner side, with mechanism responsive to door unlocking at the door inner side, to secure both deadbolt release and door unlatching.

SUMMARY OF THE INVENTION

It is a major object of the invention to provide improvements on apparatus meeting the above needs. Basically, and in accordance with the invention, a multi-function door lock system is provided, comprising:

a) a frame having opposite sides, and installable on a door openable between an interior space and an exterior space, b) a deadbolt and a door latch carried by the frame to move between retractable and extended positions, c) a first rotary control located at one level on the frame to control deadbolt movement between extended and retracted positions via primary cam mechanism, d) a second rotary control at another level on the frame to control latch movement between extended and retracted positions, via secondary cam mechanism, e) means operatively connected between said secondary cam mechanism and said primary cam mechanism to effect deadbolt movement as aforesaid, in response to operation of the second rotary control, as effected via rotary input to the second rotary control from only one side of the frame.

As will be seen, and in a preferred form of the invention, the above e) means includes a strut or link provided to extend between the secondary and primary cam mechanisms and bodily movable in response to the rotary input to said second rotary control.

Another object includes provision of the first rotary control to have input means presented at opposite sides of the frame for effecting operation of the first rotary control from either side of the door to which the frame is installed; and provision of the second rotary control to have input means presented at opposite sides of the frame, for effecting operation of the second rotary control from either side of the door to which the frame is installed.

Typically, finger and thumb operated rotors are provided at opposite sides of the frame, corresponding to opposite sides of a door carrying the frame, and are connected with the first rotary control for controlling deadbolt positioning. Also, and typically, handle levers are provided for operation at opposite sides of the frame, to be connected with the second rotary control, for controlling latch positioning. In this environment, only the lever at the inner side of the frame, and door, release both the deadbolt and door latch in response to turning of that lever.

Yet another object is to provide split-cam means to operate in conjunction with operation of the first rotary control. And a further object is to provide second split-cam means to operate in conjunction with operation of the second rotary control and displacement of the strut.

A further object includes provision of a selector means whereby turning of the handle at the door exterior optionally effects latch retraction and deadbolt retraction, simultaneously.

An added object is to provide a deadbolt actuating lever, and two cam followers associated with the lever to be displaced in opposite rotary directions, respectively, to displace the deadbolt between extended and retracted positions, and in response to operation of a primary cam defined by said primary cam mechanism.

An additional object is to provide a link having operative connection to said lever to displace the actuating lever in a rotary direction to effect extension of the deadbolt, in response to said rotary input to said second rotary control.

A further object includes provision of means responsive to reverse rotation of the first rotary control to effect latch retraction independently of deadbolt displacement.

These and other objects and advantages of the invention, as well as the details of an illustrative embodiment, will be more fully understood from the following specification and drawings, in which:

DRAWING DESCRIPTION

FIG. 22 is a view like FIG. 5, but showing split cam structure, the deadbolt being in locked extended position, and the latch also being extended.

FIG. 23 is an enlarged section taken on lines 23-23 of FIG. 22;

DETAILED DESCRIPTION

Figure 1:
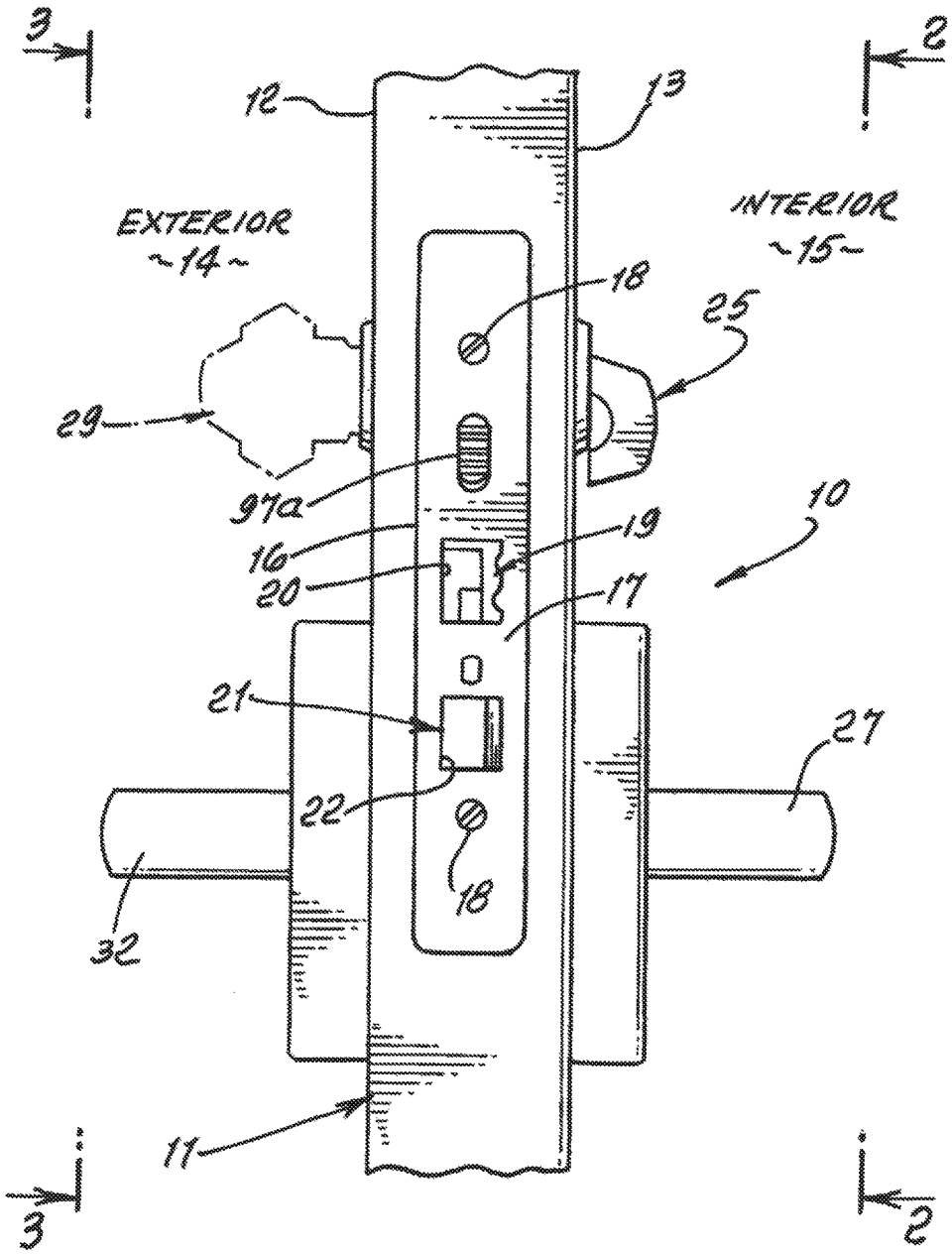
FIG. 1 is an elevation showing a door edge with two inputs (latch key and handle) from the door extension side, and two inputs (finger and thumb, knob and door handle) from the door interior side.

In the drawings, a preferred multi-function door lock system or apparatus 10, has a mounting frame 11 sized for insertion into a door opening 11'.

Figure 2:
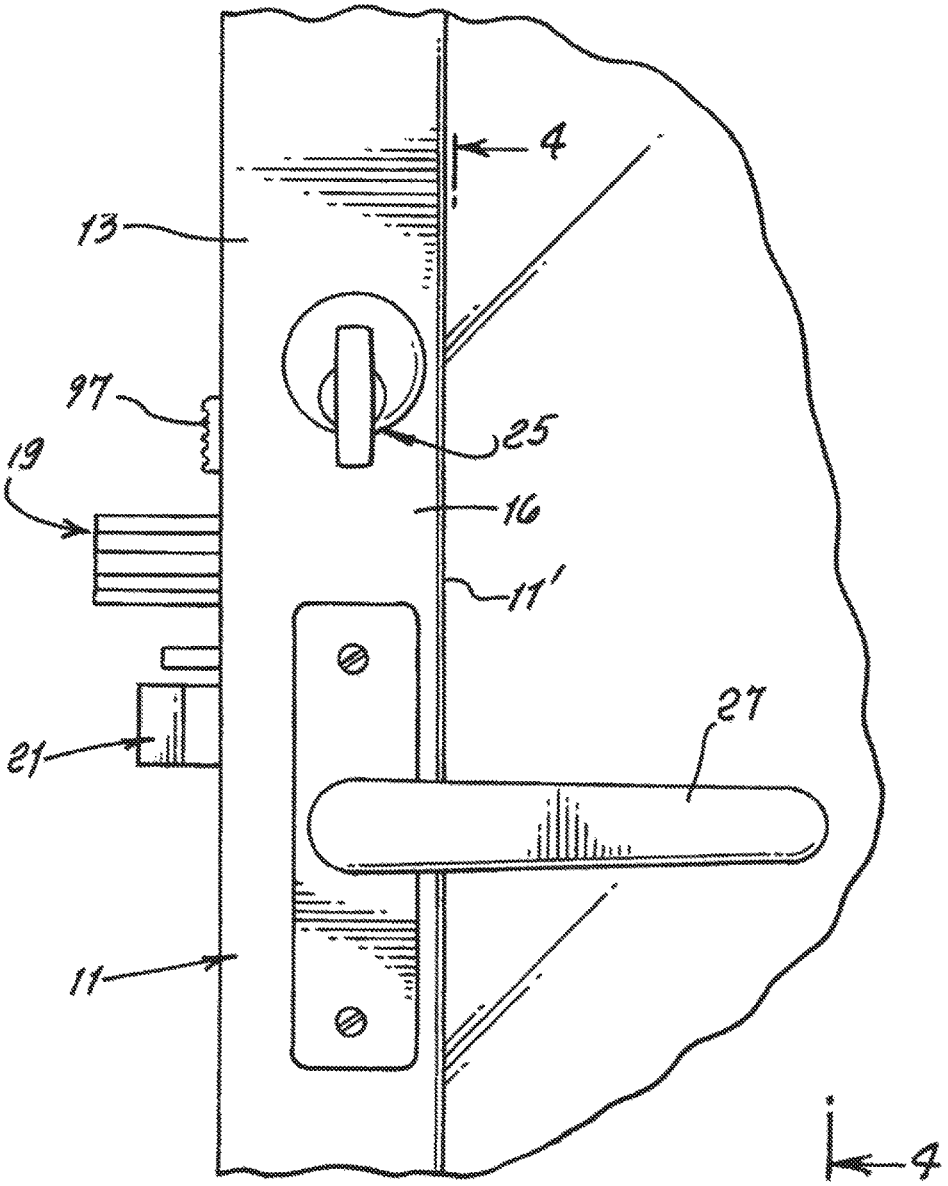
FIG. 2 is an elevation taken on lines 2-2 of FIG. 1.
Figure 3:
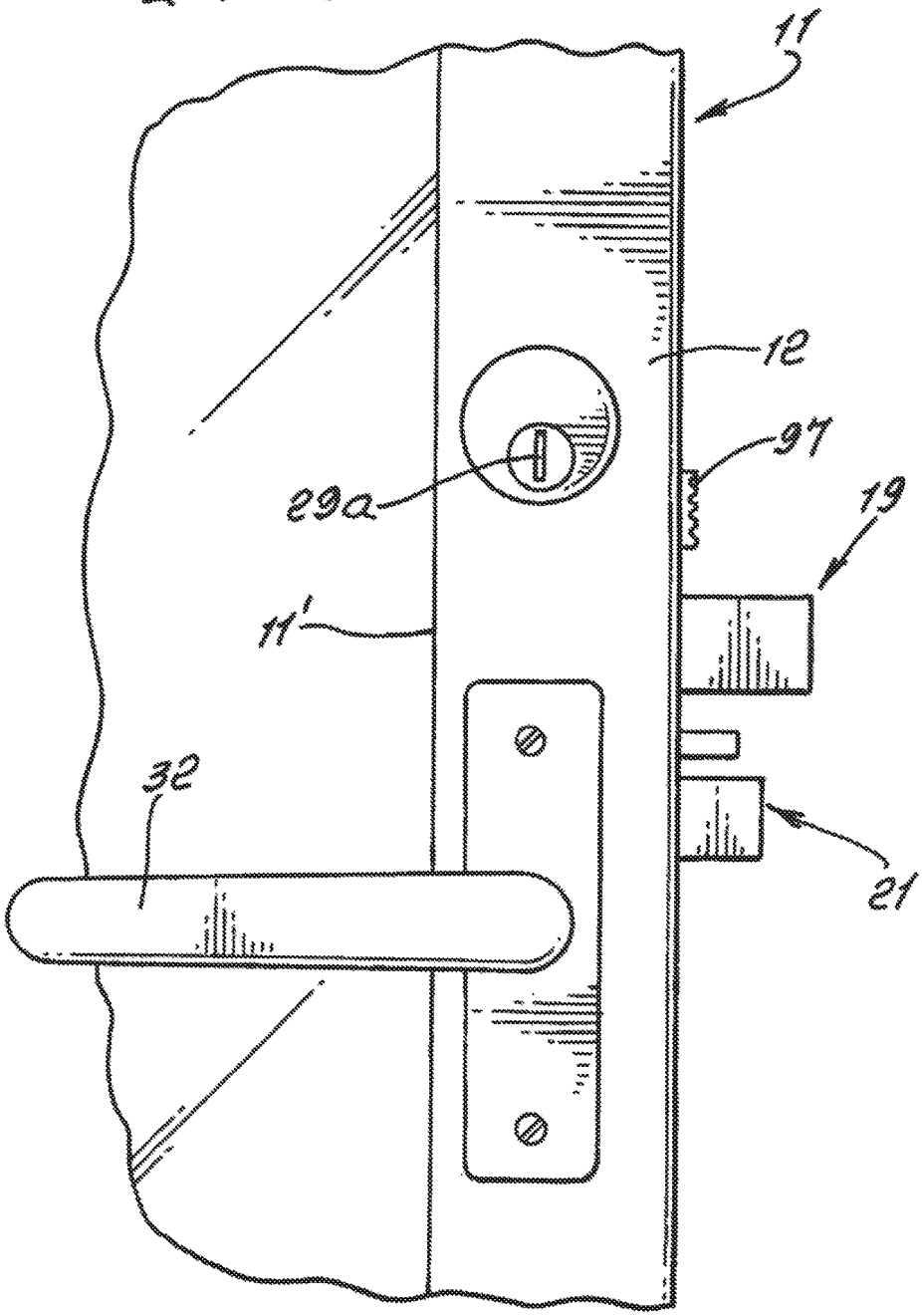
FIG. 3 is an elevation taken on lines 3-3 of FIG. 1.
Figure 4:
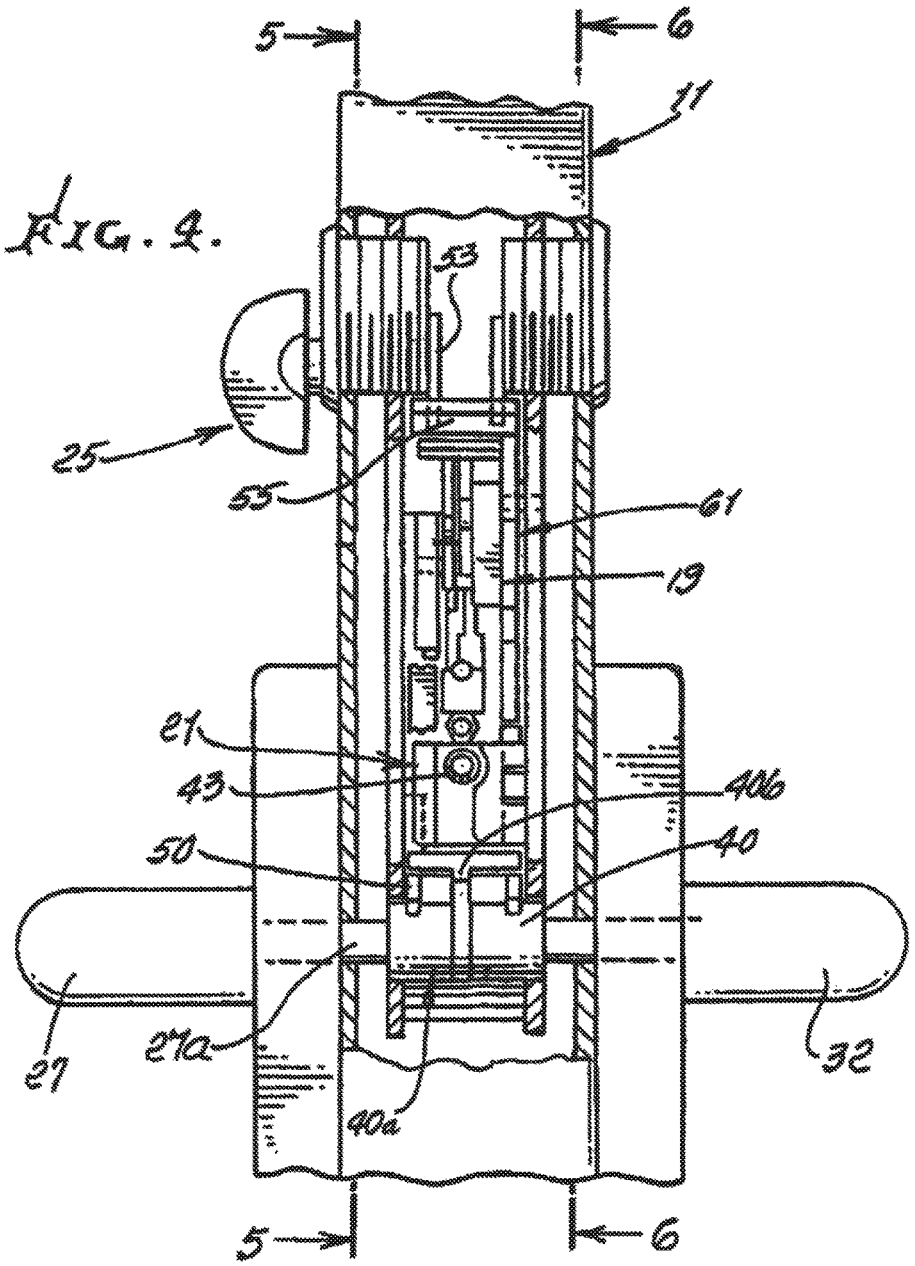
FIG. 4 is a vertical section taken on lines 4-4 of FIG. 2.
Figure 6:
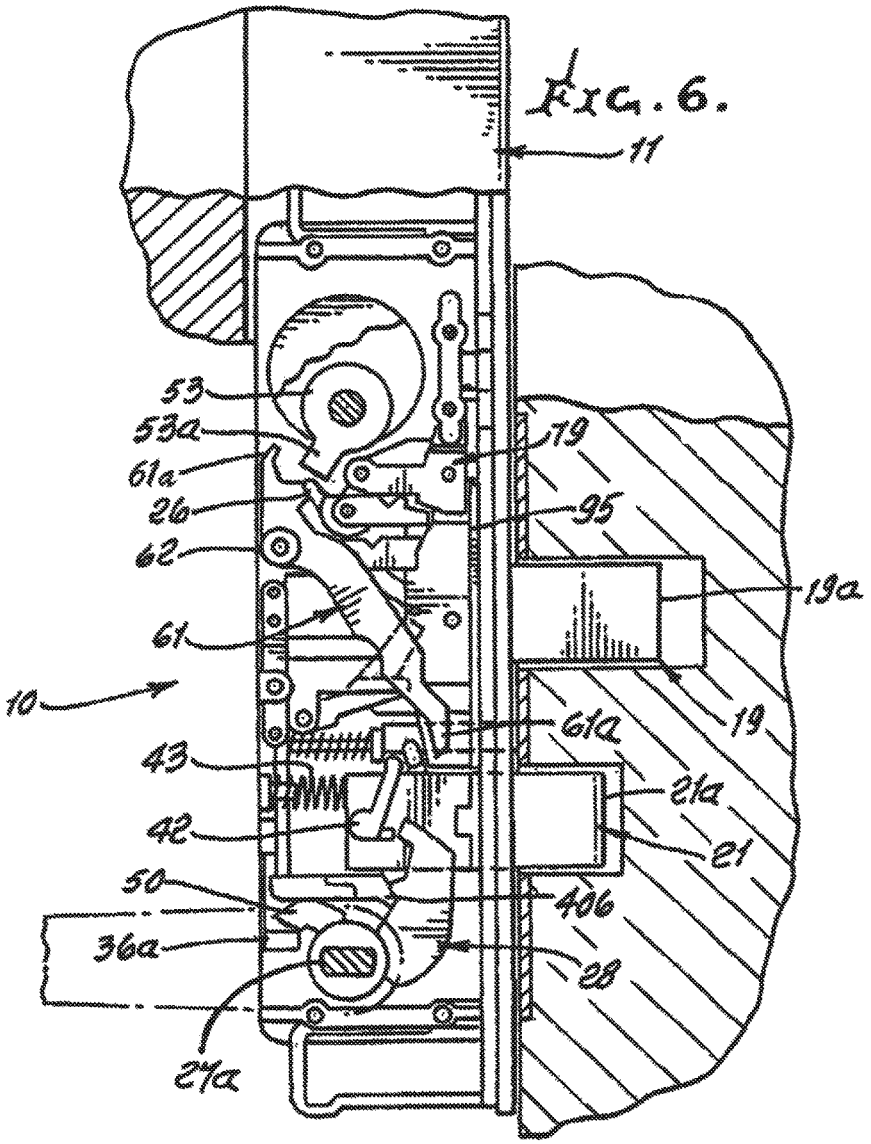
FIG. 6 is an elevation taken on lines 6-6 of FIG. 4; and showing both deadbolt and latch elements extended into openings in a door frame; and as viewed from the door exterior side.
Figure 7:
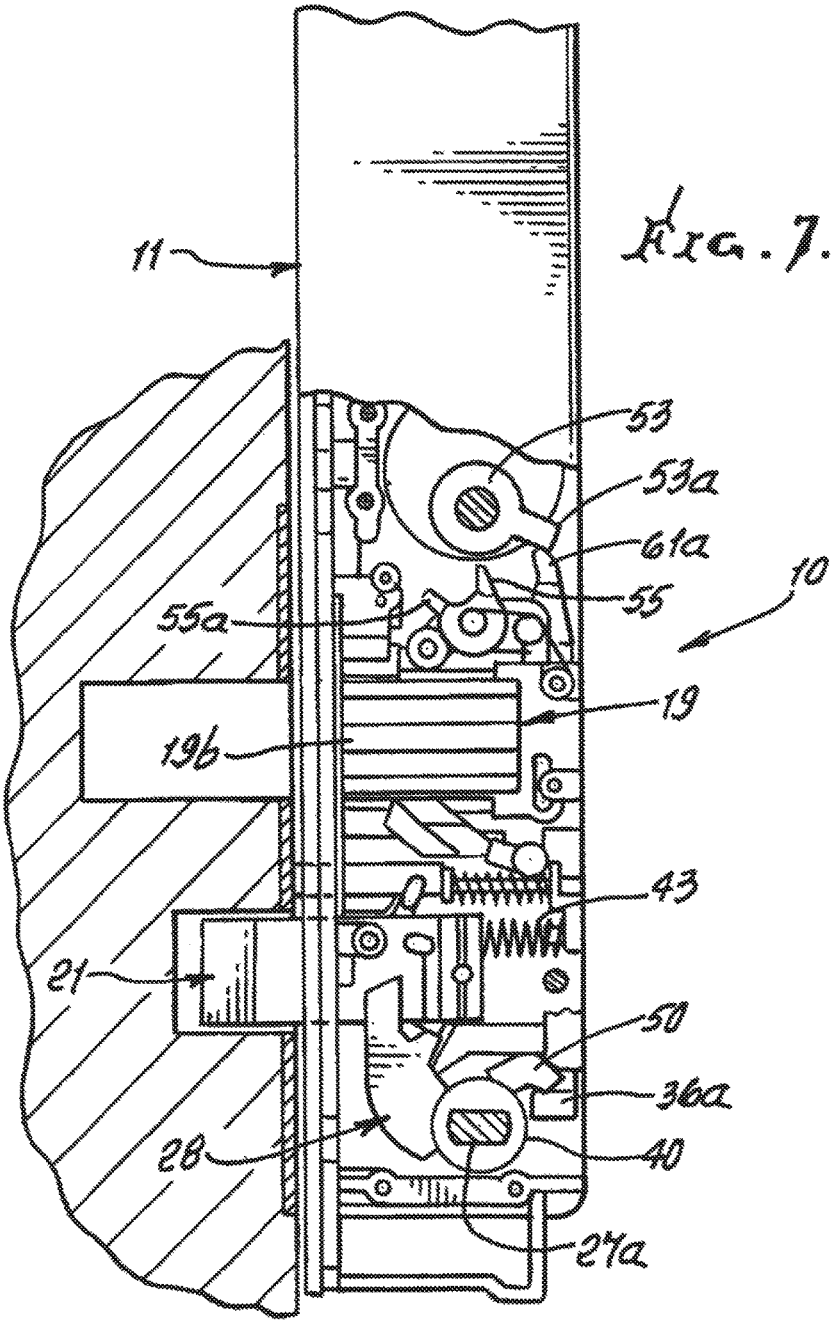
FIG. 7 is a view like FIG. 5, but showing the deadbolt retracted, and latch extended.
Figure 11:
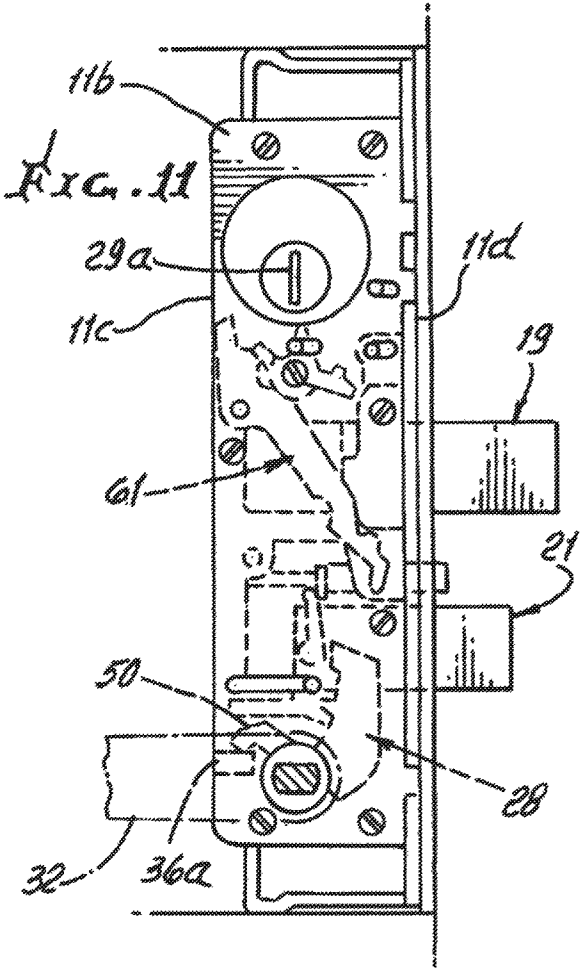
FIG. 11 is a view like FIG. 6, but showing locked positions of different actuator elements.
Figure 10:
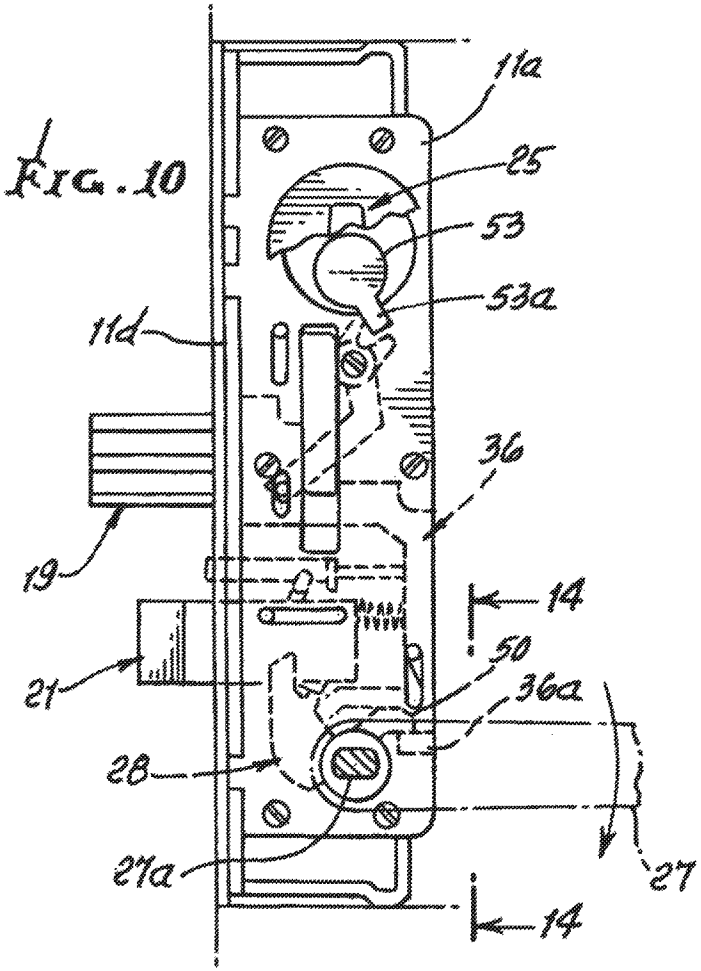
FIG. 10 is a view like FIG. 5, but showing locked positions of different actuator elements.

The frame has opposite sides 12 and 13 which respectively face toward the door exterior 14, and the door interior 15. The front side 16 of the frame is carried by a mounting plate 17 held in position by fasteners 18, as seen in FIG. 1. As also seen in FIG. 2, a deadbolt 19 is carried by the frame to protrude from the plate 17, via opening 20, as the bolt is moved between extended position 19*a* (see FIG. 6) and retracted position 19*b* in the frame (see FIG. 7); and a latch bolt or latch 21 is carried by the frame to protrude from plate 17 via opening 22, as it is moved between extended position 21*a* and retracted position in the frame. Elongated frame structure appears at 11*a*-11*d*. See FIGS. 10 and 11.

Figure 5:
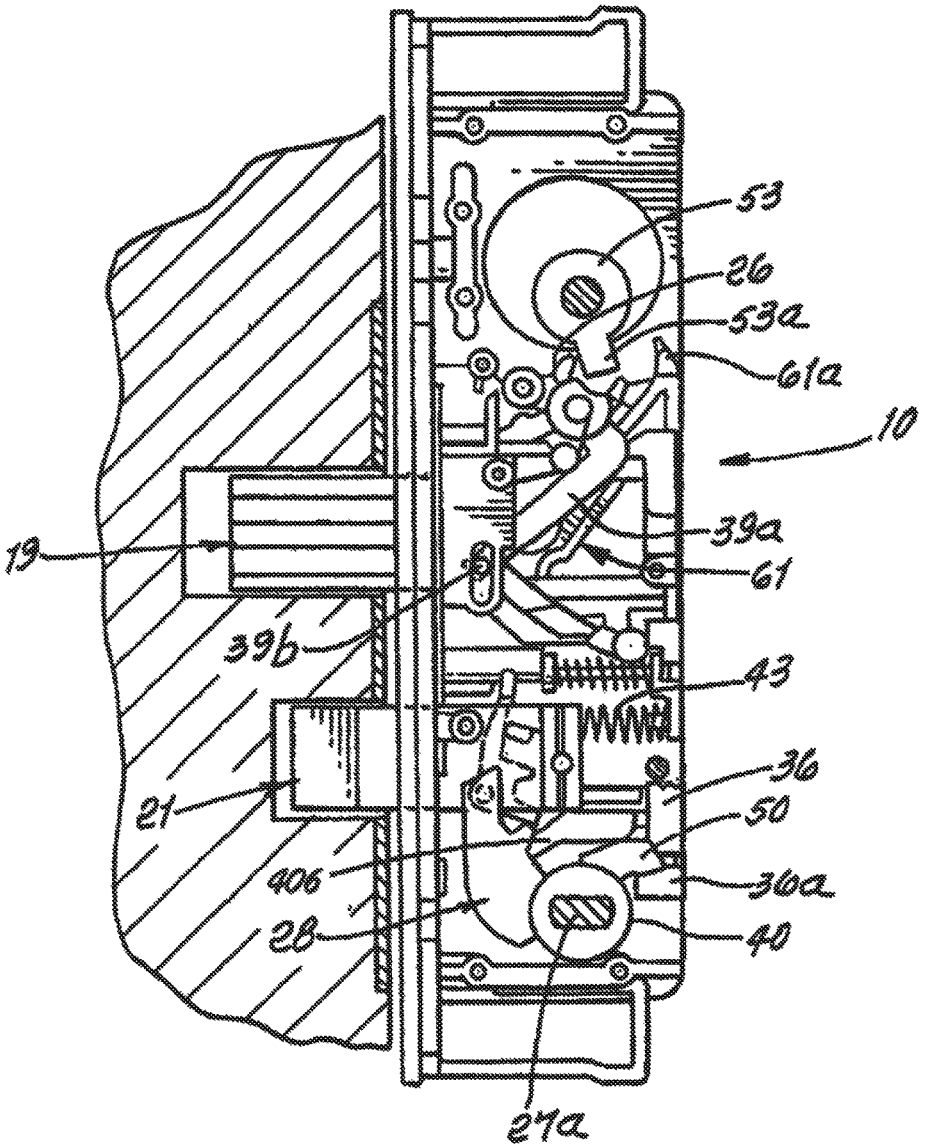
FIG. 5 is an elevation taken on lines 5-5 of FIG. 4 and showing the frame and actuating mechanism within the frame, as viewed from the door interior side; both deadbolt and latch elements extended.

A first rotary control such as rotary actuator 25 is located at one level on the frame, at the interior side of the door, for example, to control deadbolt movement between extended and retracted positions via compact mechanism in the frame. That mechanism typically includes primary cam 26. Actuator 25 is typically gripped by the user's thumb and finger, to be turned in operating the deadbolt. A second rotary control, such as handle 27 is located at a second and typically lower level, to project from the frame, at the interior side of the door, for example, to control latch 21 movement between extended and retracted positions via compact mechanism in the frame, that mechanism typically including secondary cam mechanism 28. See FIG. 5.

FIG. 1 also shows a key 29 projecting or inserted via keyhole 29 at the exterior side of the door, i.e. opposite from rotary actuator 25, to be operatively connected with the first rotary control for moving the deadbolt (as between extended or locking positions, and a retracted or unlocking position). Also FIG. 1 shows a second handle or handle lever 32, projecting at the exterior side of the door, and at the opposite side of the frame from handle 27. Handle 32 is operatively connected with the second rotary control mechanism as is handle 27 to control latch movement between extended and retracted positions, in response to manual down-turning of handle 32, at the exterior side of the door.

Latch movement between extended and retracted positions occurs in response to turning of either of handles 27 and 32 as effected via compact secondary cam mechanism 28.

Figure 13:
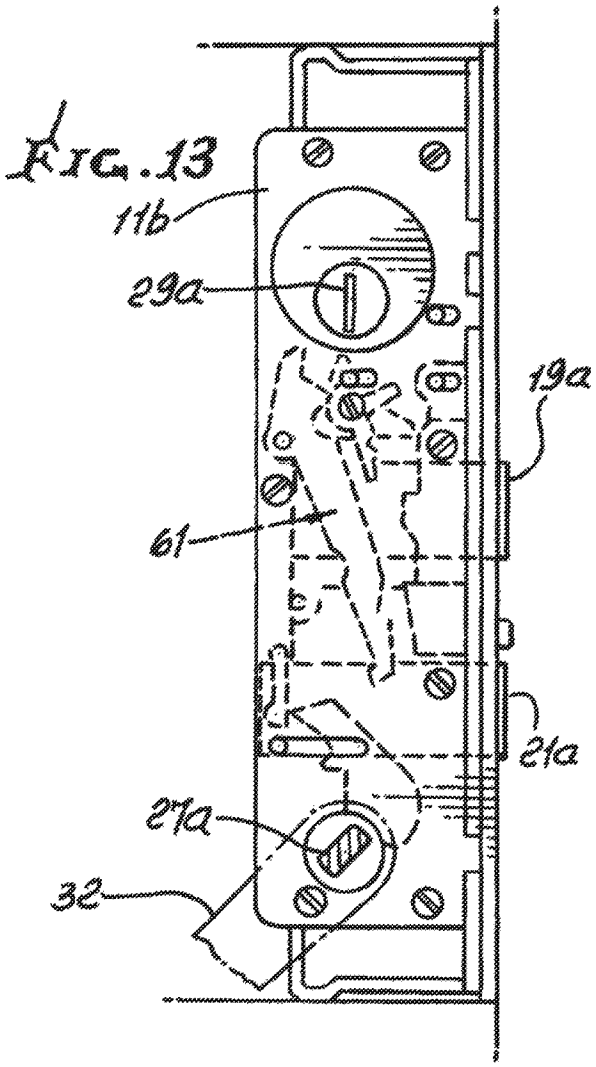
FIG. 13 is a view like FIG. 11 but showing unlocked positions of the elements seen in FIG. 11.
Figure 12:
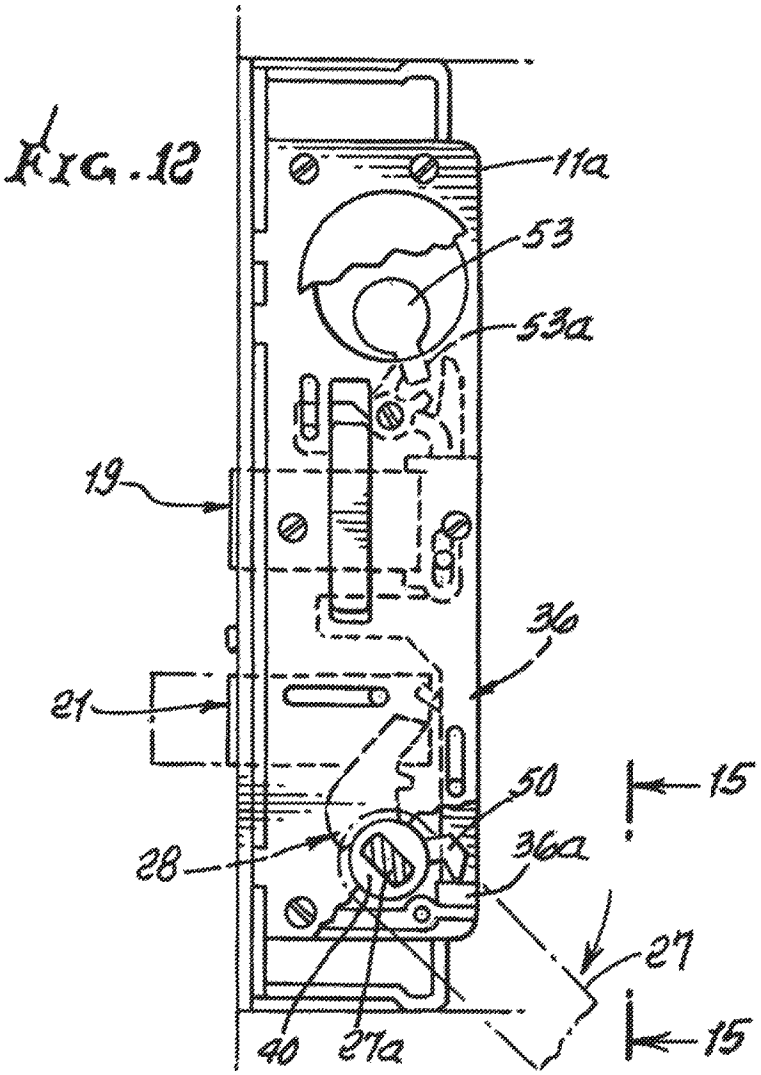
FIG. 12 is a view like FIG. 10 but showing unlocked positions of the elements seen in FIG. 10.
Figure 14:
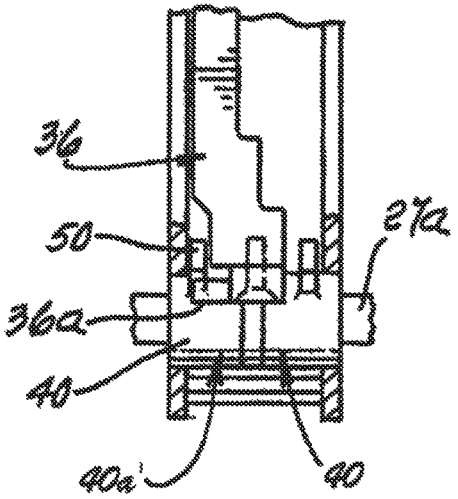
FIG. 14 is a fragmentary section taken on lines 14-14 of FIG. 10.
Figure 15:
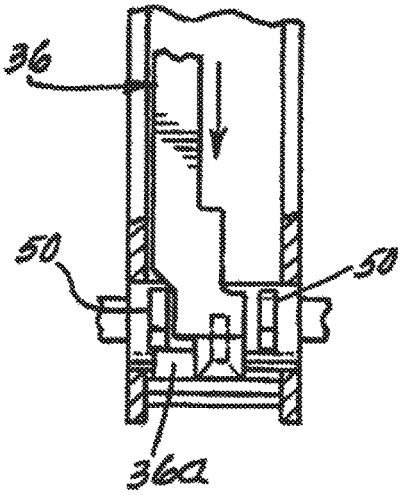
FIG. 15 is a fragmentary section taken on lines 15-15 of FIG. 12.
Figure 16:
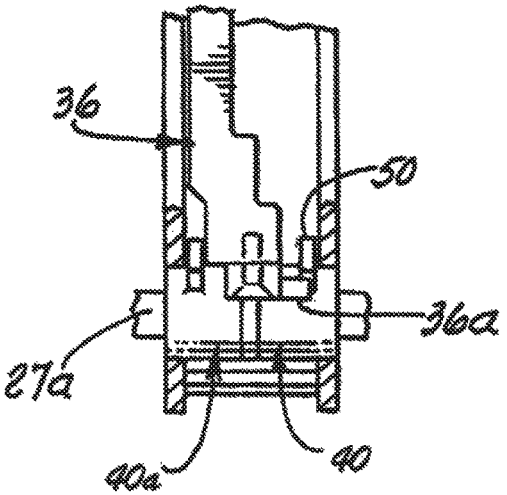
FIG. 16 is a fragmentary section, like FIG. 15, but viewing the frame with extended and interior sides reversed.
Figure 17:
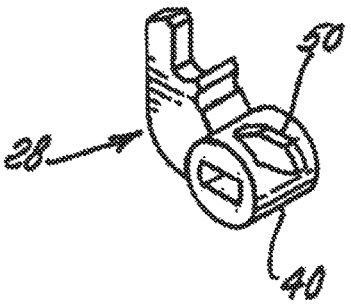
FIG. 17 is a perspective view of an actuator arm seen in FIGS. 12 and 13.
Figure 19:
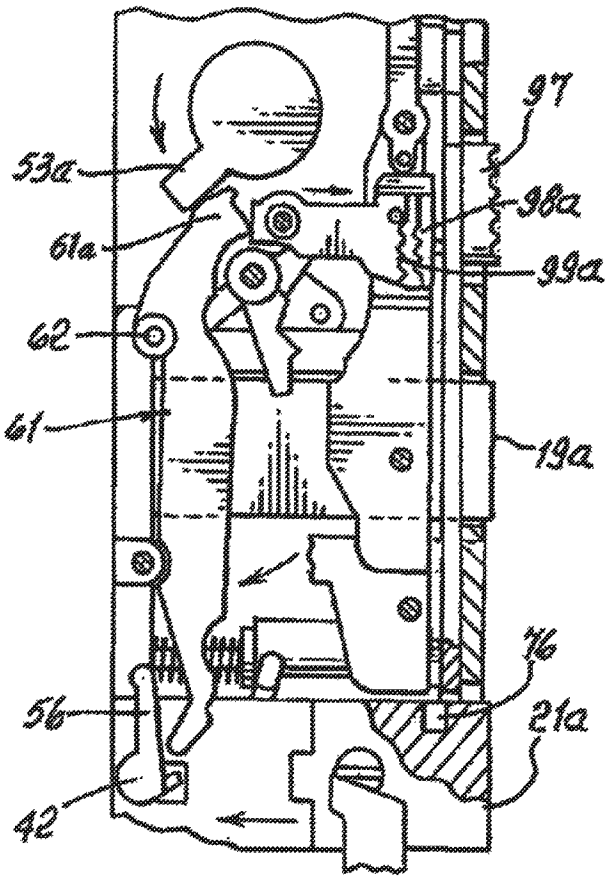
FIG. 19 is like FIG. 18 but shows the holdback mechanism in sidewardly disengaged position, with the latch bolt in retracted position.
Figure 18:
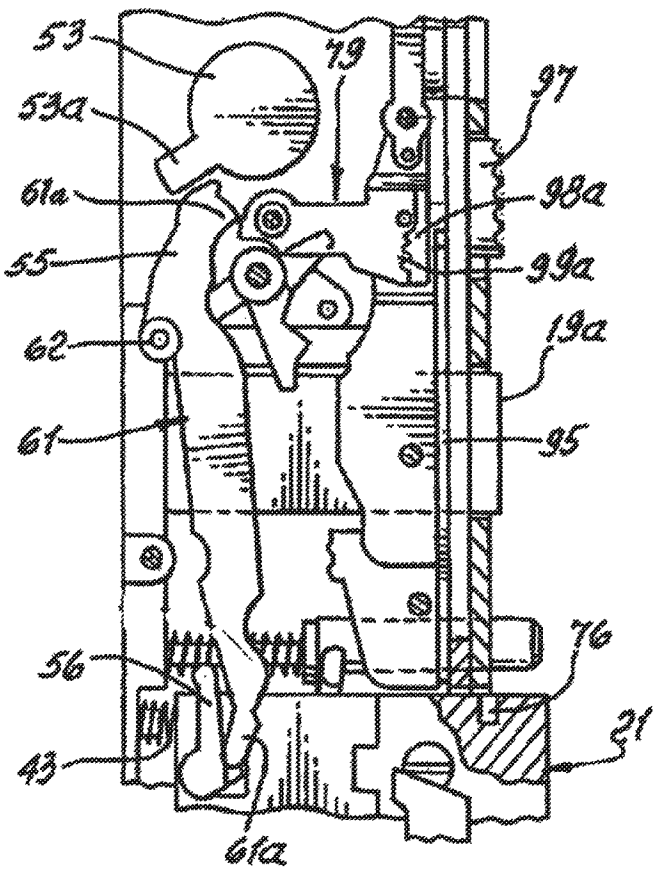
FIG. 18 is a section showing holdback mechanism in engaged position; with latch bolt in extended position.
Figure 31:
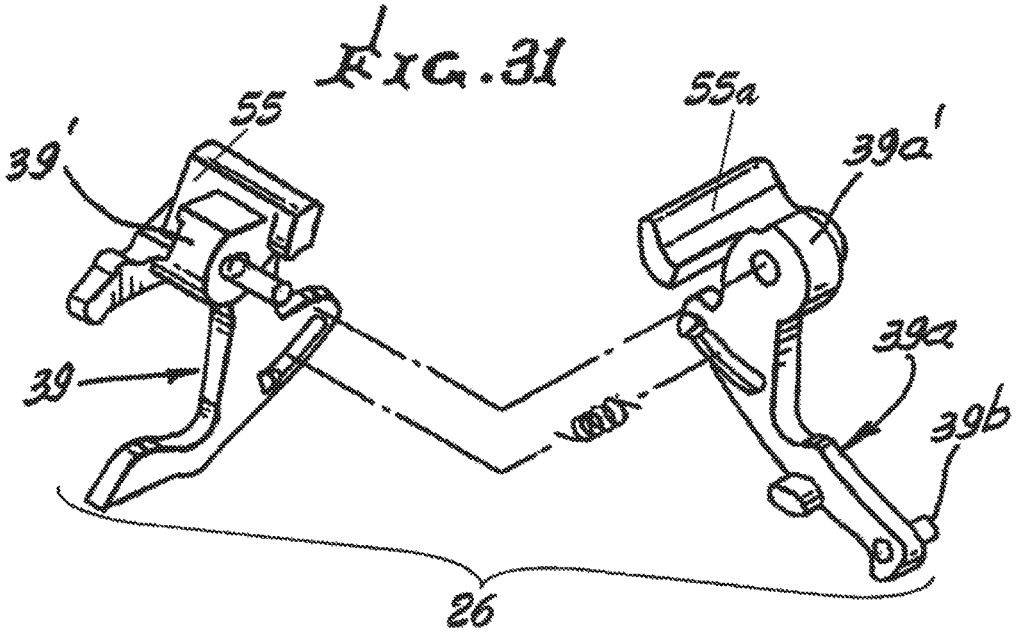
FIG. 31 is an exploded perspective view showing split cam mechanism.
Figure 29:
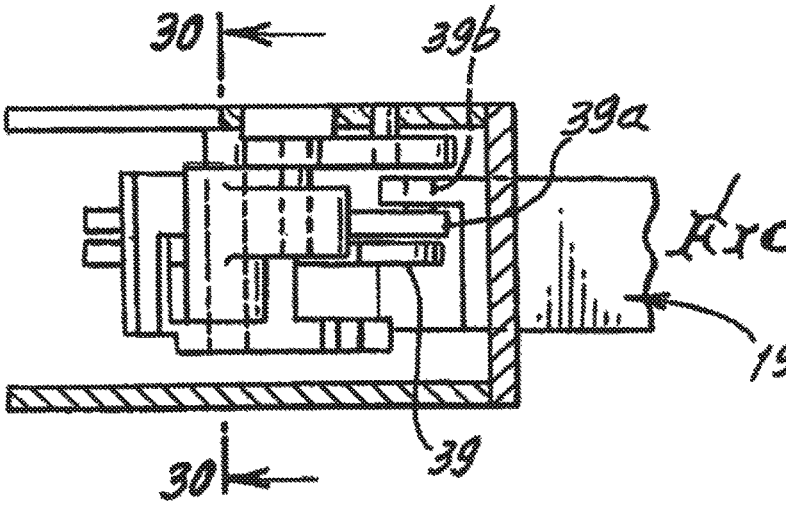
FIG. 29 is a plan view section taken on lines 29-29 of FIG. 24, elements being locked.
Figure 30:
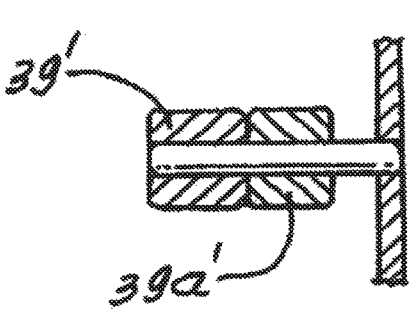
FIG. 30 is a section taken on lines 30-30 of FIG. 29.
Figure 32:
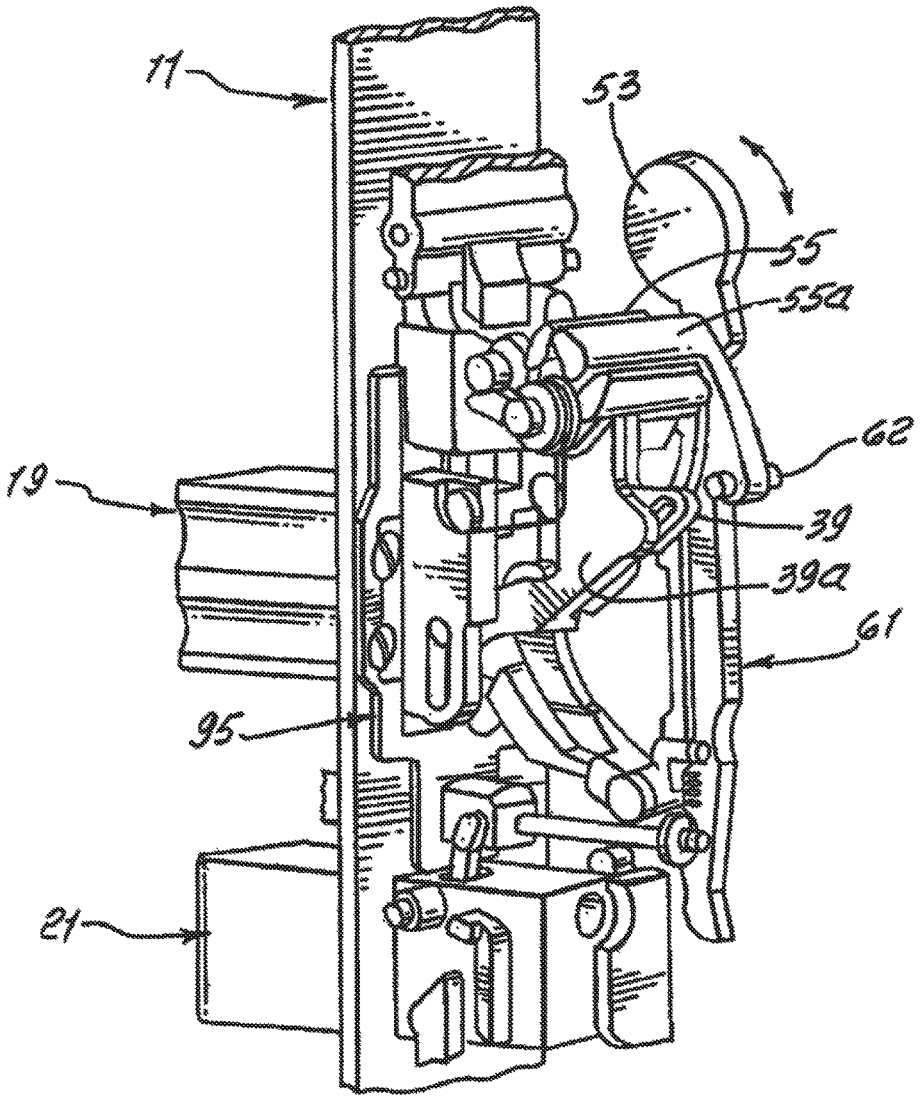
FIG. 32 is a perspective view of mechanism elements.
Figure 33:
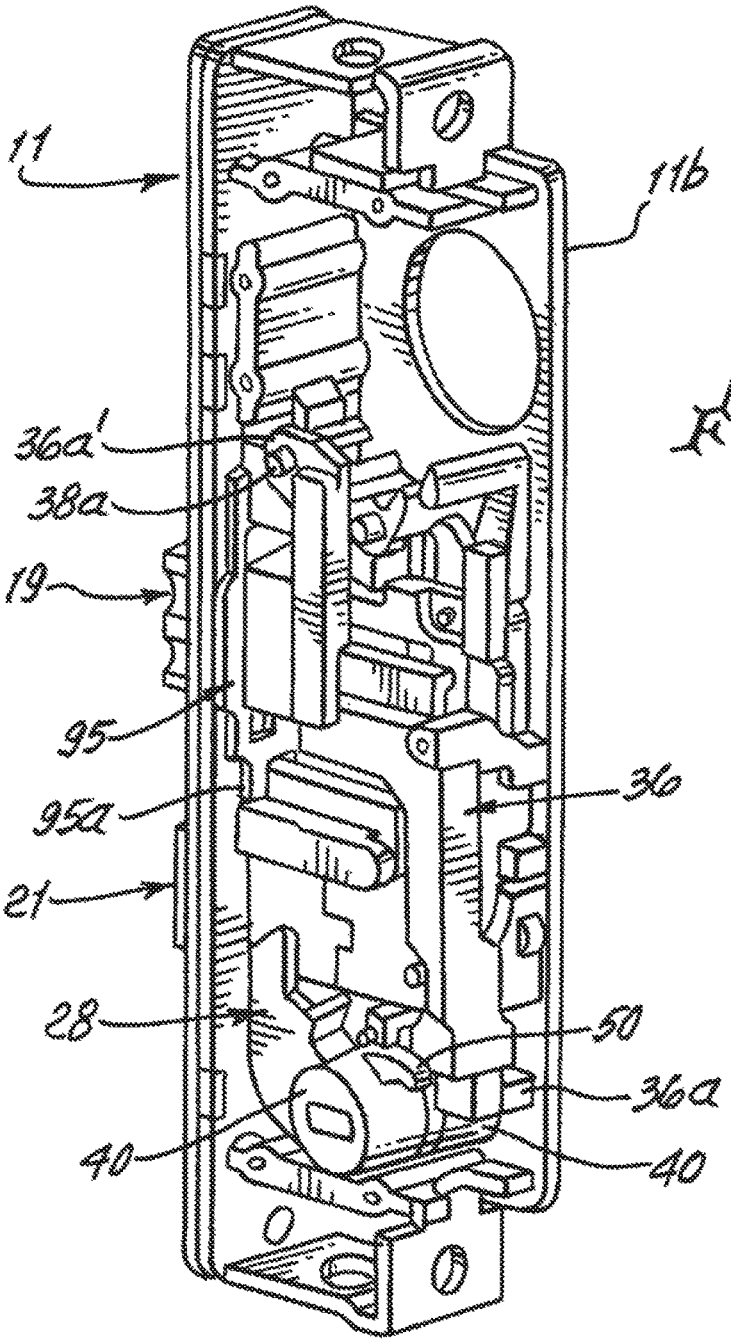
FIG. 33 is a view similar to FIG. 32, but showing additional elements.

It is a feature of the invention that means is provided and operatively connected between the secondary cam mechanism 28 and primary cam mechanism 26 comprised of upper split cam parts 55 and 55*a* and arms 39 and 39*a* to effect deadbolt movement as aforesaid in response to operation of said second rotary control, as effected via rotary input to said second rotary control from only one side of the frame. Thus, for example, as interior side handle 27 is turned to turn shaft 27*a*, not only is the latch retracted from extended position in engagement with the door frame or associated hardware, at opening 22, (see FIGS. 12 and 13) but also the deadbolt is retracted from extended position in engagement with the door frame or associated hardware, whereby a person trapped at the door interior side (building room side) can quickly escape from that interior by opening the deadbolt locked and latch engaged door in response to emergency turning of handle 27 alone; this occurs even though actuator 25 and key 29 are not manipulated. This is enabled by provision and operation of lower secondary cam mechanism 28 situated on each of split hubs 40 and 40*a* effecting downward translation of a link 36 (see FIG. 12) which extends upwardly into operative engagement or connection with compact upper or primary split cam mechanism 26, which in turn effects deadbolt retraction from locking or extended positions. In this regard, as the secondary split cam mechanism is operated by handle 27, the latch is retracted from engagement with the door frame or associated hardware. As a result, the door is completely unlocked, i.e. is free for swinging to allow "panic" escape. See in this regard lower split cam mechanism arm 50 in FIGS. 12 and 25, rotating into engagement with foot 36*a* of link 36 to displace 36 downwardly, as in FIG. 25. This causes or effects downward movement of arm extension 36*a*', pin guided at 36*c*, to push pin 38*a* down to engage arm 38, rotating it and actuating arm 39 clockwise in FIG. 25. This causes downward and leftward movement of actuating arm 39, of the upper split cam (see also FIG. 31), so that a pin 39*b* extending in deadbolt slot 49 retracts the deadbolt due to pin 39*b* movement to the left, in vertical lost motion slot 49 in the deadbolt 19, retracting the deadbolt to the left, in FIG. 26. Arms 39 and 39*a* of the upper split cam extend from hubs 39' and 39*a*', in FIG. 31. The arms are assembled side by side. See FIG. 30.

Figure 24:
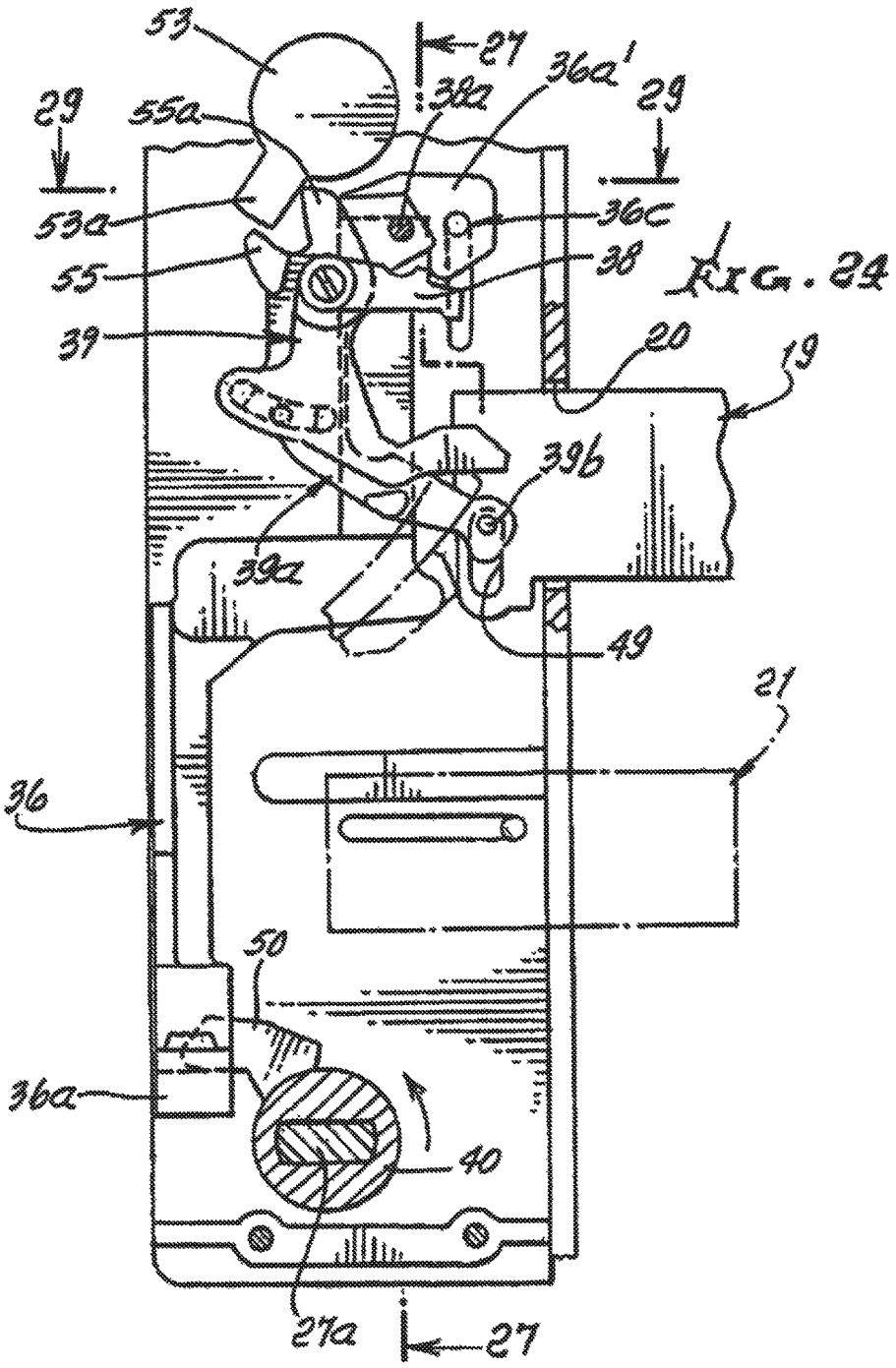
FIG. 24 is a view like FIG. 6, and showing split cam mechanism in deadbolt extended and locked position, with a deadlock arm in actuated position.

In this regard, return of the deadbolt to the right in FIG. 24 is effected by rotation of key 29 or by actuator 25, rotating the rotor 53 clockwise in FIG. 24. A lug 53*a* on 53 then cams or rotates the upper split cam part 55 counterclockwise, which rotates 39*a* counterclockwise, pushing the deadbolt to the right, via pin 39*a* movement in slot 49.

Alternatively, rotation of rotor 53 counterclockwise by the key causes lug 53*a* to push the corresponding upper split cam part 55*a* and actuating arm 39 clockwise to retract the deadbolt.

Figure 8:
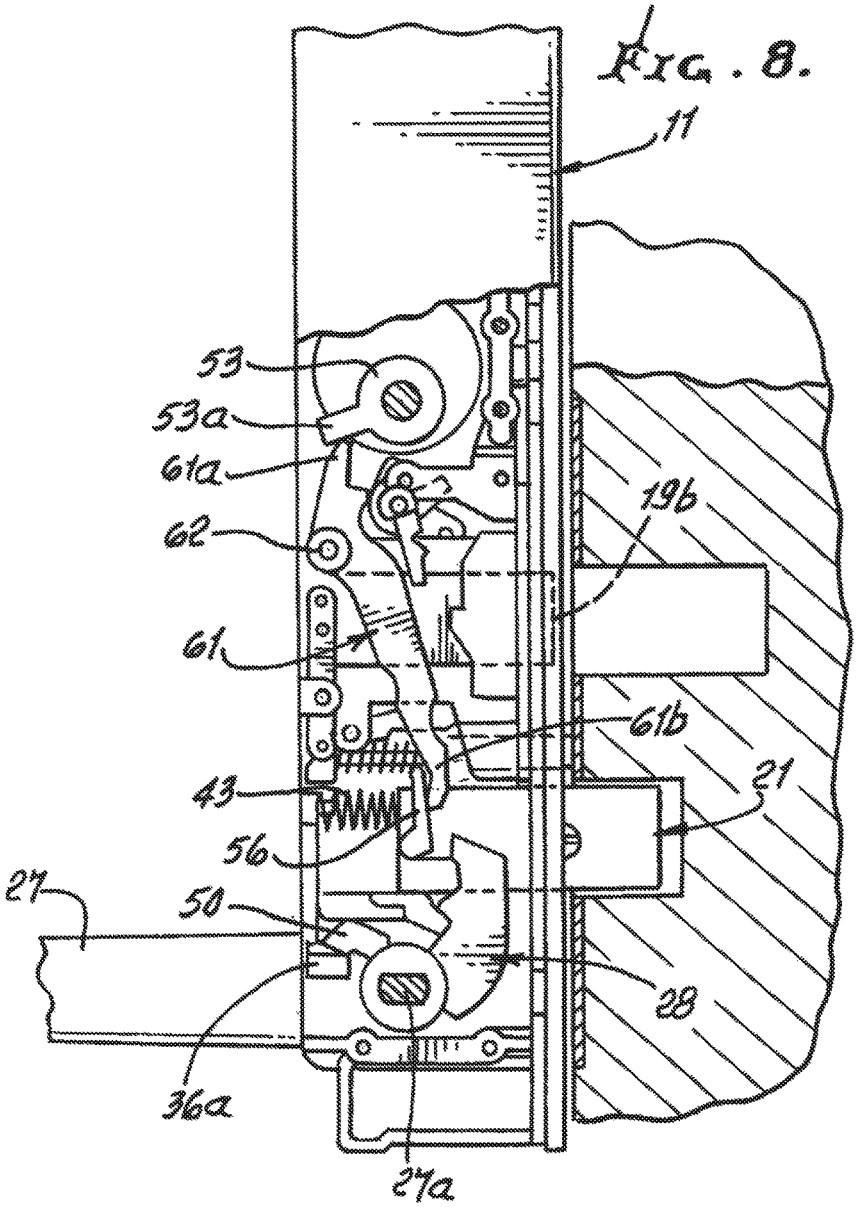
FIG. 8 is a view like FIG. 6, but showing the deadbolt retracted and latch extended.
Figure 9:
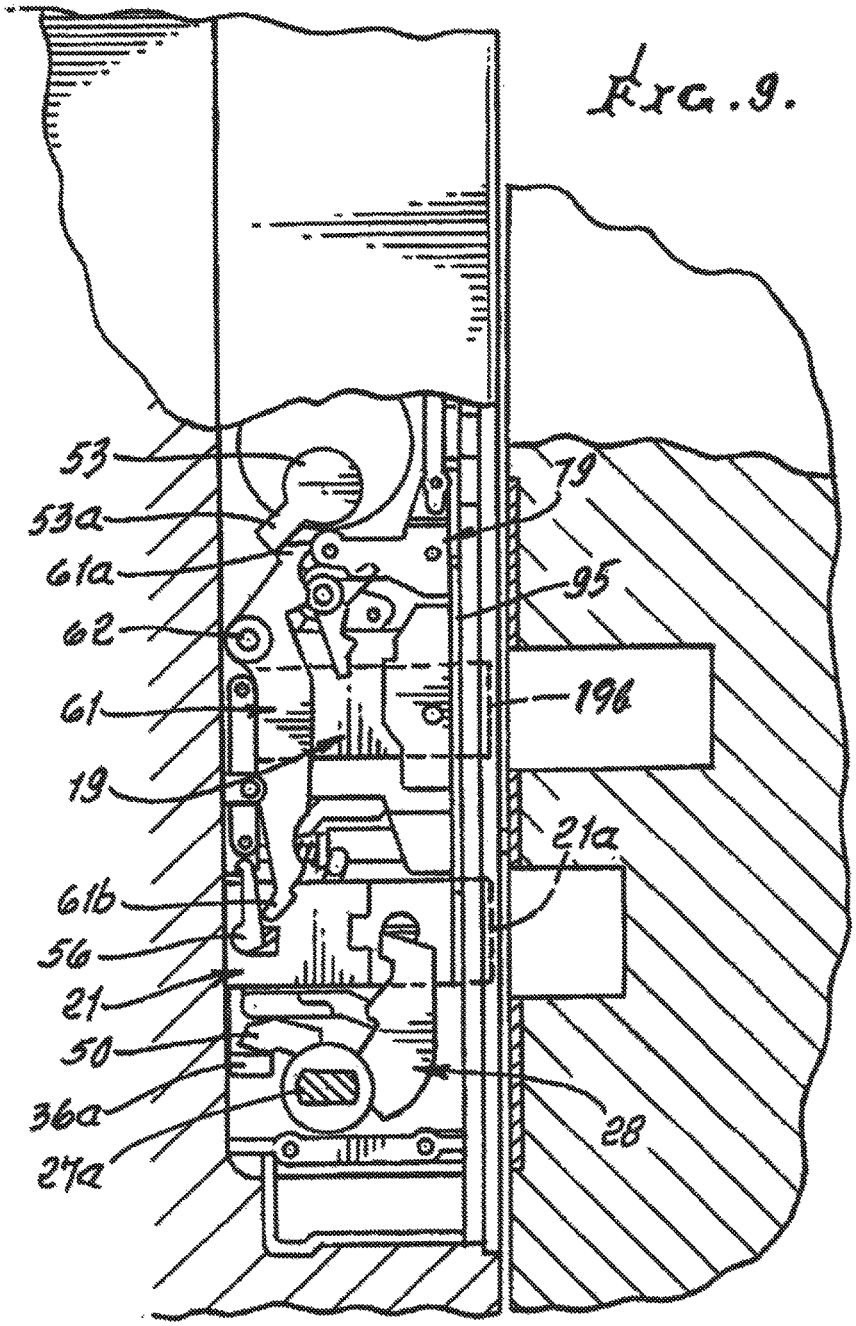
FIG. 9 is a view like FIG. 8 but showing both the deadbolt and latch retracted, whereby the door can freely swing between locations at opposite sides of the door frame.

FIGS. 8 and 9 also show mechanism to retract the latch 21 in response to reverse (counter-clockwise) rotation of rotor 53 by either of actuator 25 or key 29, seen in FIG. As shown, dog or lug 53 on rotor 53*a* (rotated counterclockwise) engages projection 61*a* on lever 61, pivoted at 62, to rotate 61 clockwise. Lower extension 61*b* on 61 then engages protrusion 56 associated with the secondary cam mechanism to retract the latch. That mechanism includes a split hub 40 and secondary cam mechanism 28 which rotates clockwise in FIGS. 5 and 12 to engage and displace lug 42 on the latch body 21*a*, (FIG. 6) retracting the latch to the right in FIG. 5, against compression spring 43.

Arm 50 on the hub 40 is rotatable to displace foot 36*a* on link 36 downwardly. This movement causes downward translation of link 36 (see FIGS. 12-17 and 26) effecting or enabling retraction of the deadbolt, via operation of the primary cam mechanism, as referred to above. Part 406 in FIGS. 5 and 6 does not dog secondary cam mechanism 28 but is axially spaced between 28 and 28*a*.

Figure 25:
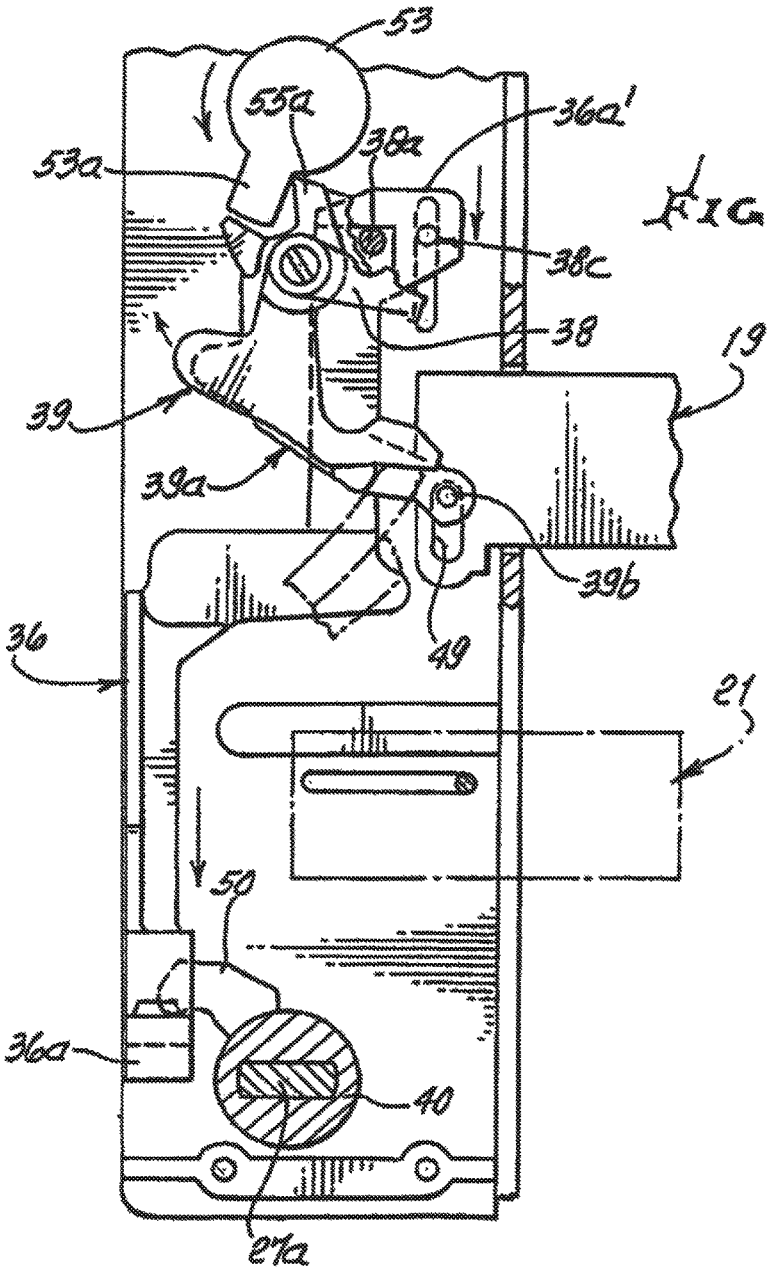
FIG. 25 is a view like FIG. 24, showing the deadlock arm moved away from the deadbolt to allow deadbolt release.
Figure 26:
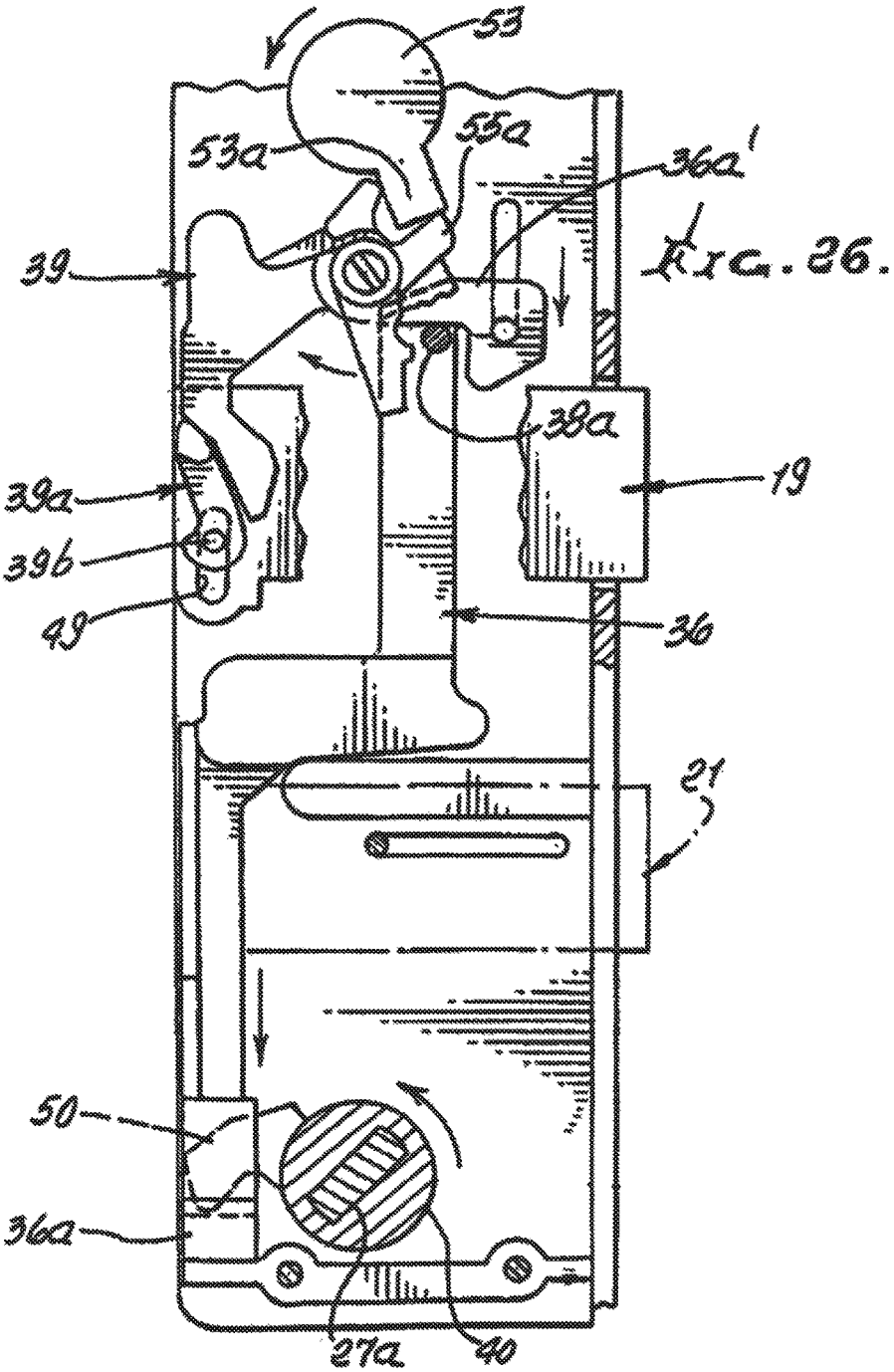
FIG. 26 is a view like FIG. 25, showing elements when deadbolt and latch are retracted.
Figure 27:
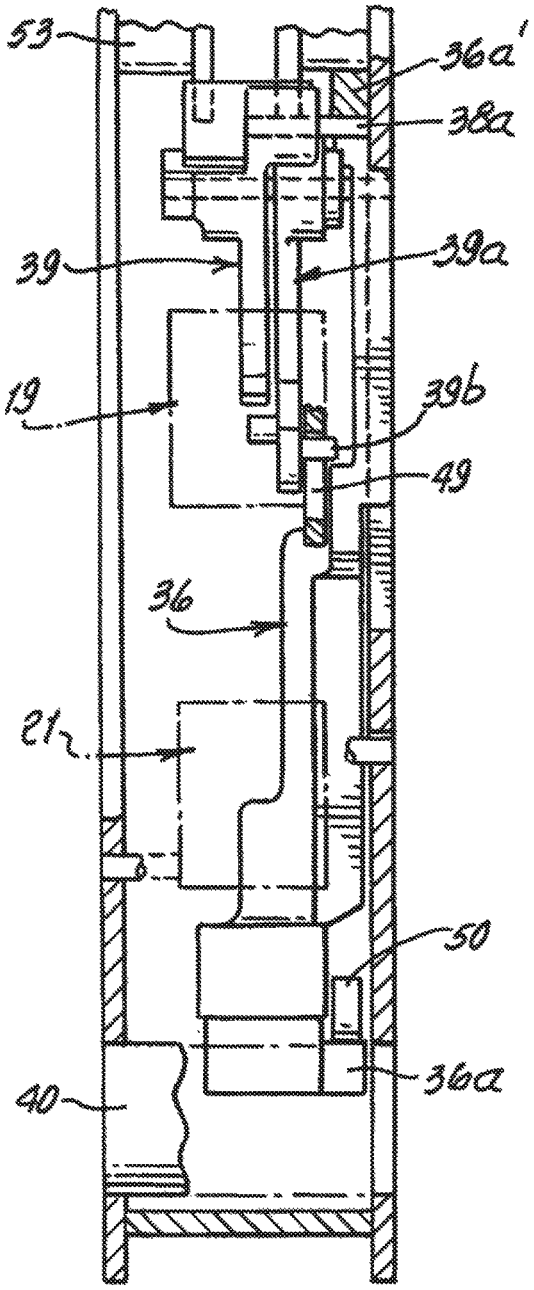
FIG. 27 is a section taken on line 27-27 of FIG. 24, elements being locked.
Figure 28:
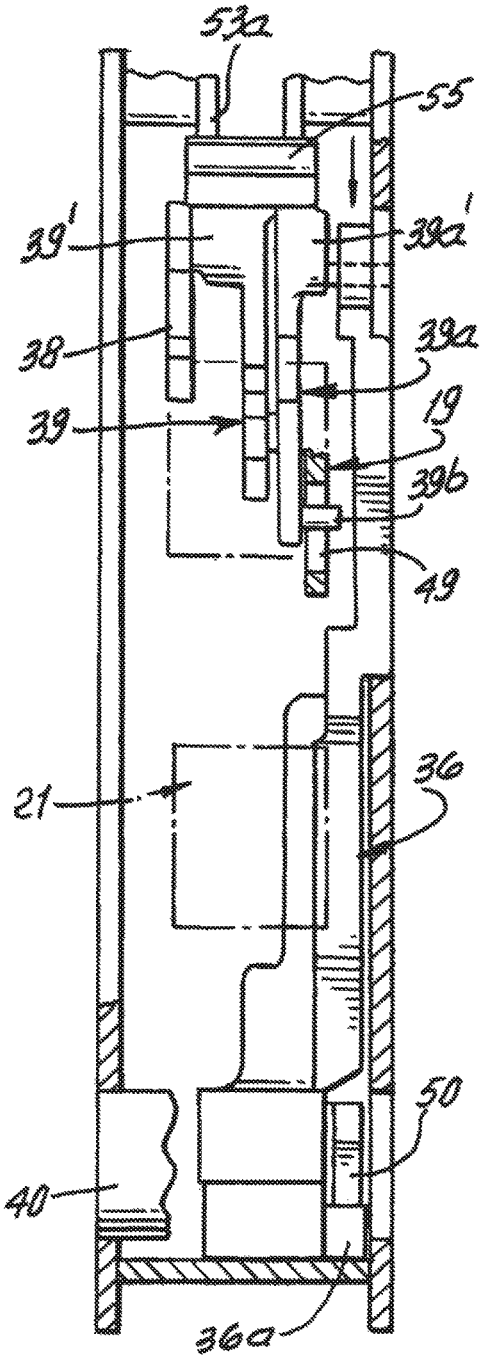
FIG. 28 is a view like FIG. 27, showing elements in unlocked positions.

In this regard, counterclockwise turning of rotor 53 in FIG. 24 in response to turning of key 29 causes lug 53*a* on the rotor to engage the primary split cam extension 55*a* on arm 39 and thereby rotate that arm clockwise in FIG. 25 for retracting the bolt. Rotor 53 is also rotatable by the actuator 25 at the interior side of the door, enabling unlocking of the deadbolt.

In FIGS. 5-9, and 17, and as referred to, secondary cam mechanism 28 carried by rotary split hub part 40 is operable upon handle actuated rotation of 40 to rotate and engage lug 42 on the latch to push the latch into retracted position. As referred to, rotation of 28 is effected by handle 27 at the inner side of the door, which also effects deadbolt retraction, via link 36. See FIGS. 14, and 25. In addition, rotation of companion split hub part 40*a* by the exterior side handle 32 (see FIG. 5) effects latch retraction via rotation of a secondary cam mechanism to engage protrusion 56 on the latch, (see FIG. 8) to push the latch into retraction, but without affecting the status of the deadbolt. To retract the deadbolt, the key 29 must be inserted and turned, to rotate rotor 53, as referred to above.

Figure 20:
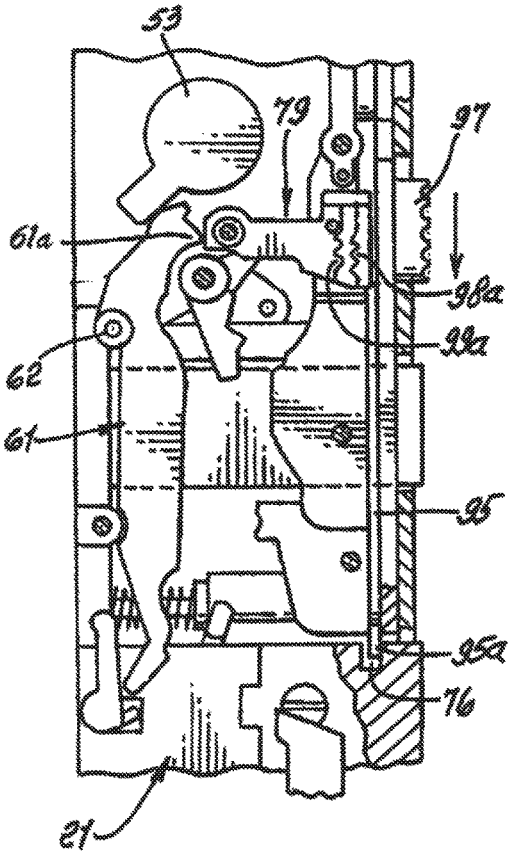
FIG. 20 is like FIG. 19, but with a hold back plate displaced downwardly into a groove in the retracted latch.
Figure 21:
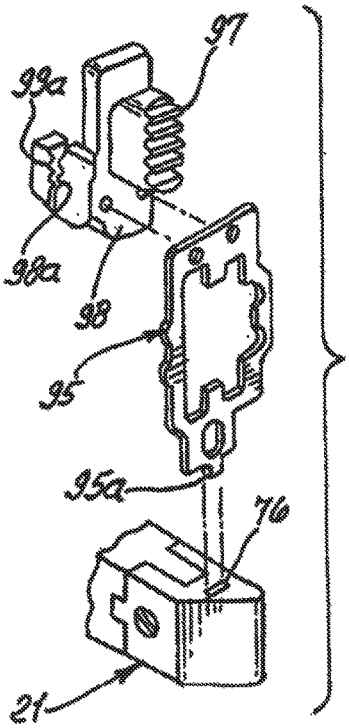
FIG. 21 is an exploded view of the latch plate, the latch bolt; and the hold back plate retainer.

FIGS. 18-21 show the provision of hold back plate 95 movable downwardly, as seen in FIG. 20, to effect insertion of the plate lower tip portion 95*a* into a groove 76 in the top of the latch 21. This holds the latch against movement into latching position. Plate 95 is carried by the frame for sliding movement. A serrated pusher 97 associated with the plate protrudes at 97*a* for thumb actuation, as seen in FIG. 1. A hold back plate retainer 98 is engageable by a rightwardly movable clutch 79 (see FIGS. 18 and 19) actuated by the pivotable extension 55*a* of the cam part 55, pivoted at 62*a*. When lever 61 is moved leftwardly to bring groove 76 into registration with hold back plate tip portion 95*a*, as by clockwise rotation of rotor 53, the latch 21 is displaced to the left, by lower extent of cam part of lever 61, to bring groove 76 into vertical registration with hold back tip 95*a*, at which time the hold back is movable downwardly, allowing the teeth 99*a* on clutch 79 to engage teeth 98*a* on the retainer 98 carried by the plate 95, locking the latch in retracted position.

Summary of User Operation

1. From exterior side of door, key 29 is turning to unlock (retract) the deadbolt 19. Then handle 32 is turned to retract latch 21, to open door, and also perform this function in case deadbolt was already retracted.

2. From interior side of door, rotary actuator 25 is turnable to unlock (retract) the deadbolt. Also, actuator 25 is turnable to effect retraction of latch 21, via lever 61. This enables operation of the hold back 95 and pusher 97 to enable door to swing freely.

3. From interior side of door, handle 27 can be turned to retract both latch and the deadbolt, as in an emergency.

I claim:

1. A door lock system, comprising:

a) a frame having a first side and a second side opposite said first side;

b) a deadbolt and a door latch connected to said frame configured to move between retracted and extended positions;

c) a first rotary control connected to said frame, said first rotary control having a first axis of rotation and configured to control deadbolt movement between extended and retracted positions via a primary cam mechanism rotatable about a second axis of rotation off-spaced from said first axis of rotation and acted upon by said first rotary control, wherein said primary cam mechanism includes a split two piece cam having first and second pieces each separately rotatable about said second axis of rotation, wherein said first piece includes a first actuating arm, and wherein said second piece includes a second actuating arm;

d) a second rotary control having a third axis of rotation off-spaced from said first and second axes of rotation and configured to control latch movement between extended and retracted positions; and e) a link configured to positively move said deadbolt to said retracted position in response to operation of said second rotary control when said latch is moved toward said retracted position by said second rotary control, as effected via a rotary input to said second rotary control from one of said first or second sides of said frame, wherein, upon rotary input to said second rotary control, said link is configured to move along a linear path normal to said movement of said deadbolt and said door latch and to contact said primary cam mechanism upon said link movement to affect movement of said deadbolt between said retracted and said extended positions.

2. The system in accordance with claim 1 wherein said first rotary control includes a first and second actuator disposed on said first side and said second side of the frame, respectively, wherein either of said first or second actuators is configured to effect rotation of said first rotary control.

3. The system in accordance with claim 2 wherein the second rotary control includes a first and second handle disposed on said first side and said second side of the frame, respectively, wherein either of said first or second handles is configured to effect rotation of said second rotary control.

4. The system in accordance with claim 2 wherein at least one of said first and second actuators is a finger and thumb operated rotor.

5. The system in accordance with claim 1 wherein said second rotary control includes a first and second handle disposed on said first side and said second side of the frame, respectively, wherein either of said first or second handles is configured to effect rotation of said second rotary control.

6. The system in accordance with claim 5 wherein said movement of said link occurs only upon rotation of only one of said first or second handles.

7. The system in accordance with claim 1 wherein said link effects simultaneous movement of said deadbolt and said latch between said extended and retracted positions in response to said rotary input to said second rotary control.

8. The system in accordance with claim 1 wherein said primary cam mechanism is configured to positively move said deadbolt to said retracted position in response to operation of said second rotary control when said latch is moved toward said retracted position by said second rotary control, as effected via said rotary input to said second rotary control from only one of said first or second sides of the frame.

* * * * *